US010969202B2

(12) United States Patent
Teetzel et al.

(10) Patent No.: US 10,969,202 B2
(45) Date of Patent: Apr. 6, 2021

(54) WEAPON SYSTEM

(71) Applicant: Wilcox Industries Corp., Newington, NH (US)

(72) Inventors: James W. Teetzel, Portsmouth, NH (US); Gary M. Lemire, Lee, NH (US); John P. Bousquet, Rochester, NH (US); Daniel M. Desrosiers, Epping, NH (US); Marvin S. Carter, III, Rochester, NH (US); Jansen Habrial, Brookfield, NH (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 16/275,955

(22) Filed: Feb. 14, 2019

(65) Prior Publication Data

US 2019/0249958 A1 Aug. 15, 2019

Related U.S. Application Data

(60) Provisional application No. 62/630,550, filed on Feb. 14, 2018.

(51) Int. Cl.

| | |
|---|---|
| ***F41G 11/00*** | (2006.01) |
| ***F41A 17/06*** | (2006.01) |
| ***F41G 3/06*** | (2006.01) |

(52) U.S. Cl.

CPC ..... *F41G 11/004* (2013.01); *F41A 17/06* (2013.01); *F41G 3/065* (2013.01); *F41G 11/003* (2013.01)

(58) Field of Classification Search

CPC ..... F41G 11/003; F41G 11/004; F41G 3/065; F41A 17/06; F41A 17/063; F41A 17/066; F41C 23/20

USPC ..... 42/90

See application file for complete search history.

(56) References Cited

U.S. PATENT DOCUMENTS

| | | | | |
|---|---|---|---|---|
| 3,854,231 | A | 12/1974 | Broyles | |
| 6,856,238 | B2 * | 2/2005 | Wootton | F41A 17/063 340/10.1 |
| 9,841,249 | B1 | 12/2017 | Nicks et al. | |
| 2006/0042142 | A1 * | 3/2006 | Sinha | F41C 27/00 42/1.01 |
| 2009/0188976 | A1 | 7/2009 | Gunnarsson et al. | |
| 2011/0162245 | A1 | 7/2011 | Kamal et al. | |
| 2011/0283586 | A1 * | 11/2011 | Scallie | F41A 33/00 42/84 |

(Continued)

OTHER PUBLICATIONS

International Search Report and Written Opinion dated Apr. 22, 2019 received in PCT/US2019/018008.

*Primary Examiner* — John Cooper

(74) *Attorney, Agent, or Firm* — McLane Middleton, Professional Association

(57) ABSTRACT

A weapon system for a firearm having a barrel includes a powered accessory rail interface having an upper accessory rail and a lower accessory rail. A first accessory device is removably attachable to the upper accessory rail and is configured to receive electrical power and data signals over the powered accessory rail interface. A second accessory device is removably attachable to the lower accessory rail, the second accessory device configured to receive electrical power and data signals over the powered accessory rail interface. A power supply is electrically coupled to the powered accessory rail interface.

44 Claims, 14 Drawing Sheets

(56) References Cited

U.S. PATENT DOCUMENTS

| | | | | |
|---|---|---|---|---|
| 2014/0223793 | A1* | 8/2014 | Peterson | F41C 23/14 42/71.01 |
| 2014/0360077 | A1* | 12/2014 | Miller | F41C 27/00 42/84 |
| 2015/0369554 | A1 | 12/2015 | Kramer | |
| 2016/0010949 | A1 | 1/2016 | Teetzel et al. | |
| 2016/0061560 | A1 | 3/2016 | Saadon | |
| 2016/0195351 | A1 | 7/2016 | Burden | |
| 2016/0327371 | A1 | 11/2016 | Teetzel et al. | |
| 2017/0205202 | A1 | 7/2017 | Teetzel et al. | |
| 2018/0196628 | A1* | 7/2018 | Samo | F41G 11/003 |
| 2018/0292170 | A1* | 10/2018 | Gagliano | F41G 1/467 |

* cited by examiner

WEAPON SYSTEM

CROSS-REFERENCE TO RELATED APPLICATION

This application claims the priority benefit of U.S. provisional application Ser. No. 62/630,550. The aforementioned provisional application is incorporated herein by reference in its entirety.

SUMMARY

A weapon system for a firearm having a barrel includes a powered accessory rail interface having an upper accessory rail and a lower accessory rail. A first accessory device is removably attachable to the upper accessory rail and is configured to receive electrical power and data signals over the powered accessory rail interface. A second accessory device is removably attachable to the lower accessory rail, the second accessory device configured to receive electrical power and data signals over the powered accessory rail interface. A power supply is electrically coupled to the powered accessory rail interface.

In one aspect, a weapon system for a firearm having a barrel includes a powered accessory rail interface having an upper accessory rail and a lower accessory rail. A first accessory device is removably attachable to the upper accessory rail, the first accessory device configured to receive electrical power and data signals over the powered accessory rail interface. A second accessory device is removably attachable to the lower accessory rail, the second accessory device configured to receive electrical power and data signals over the powered accessory rail interface. A power supply is electrically coupled to the powered accessory rail interface.

In certain embodiments, the powered accessory rail comprises an upper handguard and a lower handguard opposing the upper handguard, the upper handguard and lower handguard cooperating to form a sleeve around the barrel.

In certain embodiments, the powered accessory rail further comprises an electrical circuit within the sleeve.

In certain embodiments, at least a portion of the electrical circuit is formed on a flexible circuit substrate.

In certain embodiments, the upper accessory rail is attached to the upper handguard.

In certain embodiments, an accessory mounting pad is disposed on the upper handguard, the accessory mounting pad configured to removably retain the first accessory device.

In certain embodiments, the lower accessory rail is attached to the lower handguard.

In certain embodiments, the first accessory device includes a processor and a memory associated with the processor, the memory storing a program of instructions for execution by the processor.

In certain embodiments, the program of instructions comprises a ballistic calculation module, wherein ballistic calculations are based on a distance to target and at least one of ammunition type, a property of the barrel, and a rate of fire of the firearm.

In certain embodiments, the property of barrel is selected from the group consisting of barrel whip, barrel harmonics, barrel temperature, or any combination of the foregoing.

In certain embodiments, an ammunition database is stored in the memory, the ammunition database containing ballistic properties of a plurality of ammunition types for use by the ballistics calculation module.

In certain embodiments, one or more data logs are stored in the memory, the one or more data logs for storing information relating to the firearm.

In certain embodiments, the information relating to the firearm is selected from the group consisting of: a distance to target, a number of ammunition rounds fired by the firearm, barrel temperature, barrel life expectancy, barrel wear, projectile velocity, rate of fire, firearm cant, aiming direction, battery power, barrel whip, a laser sight mode, and any combination of the foregoing.

In certain embodiments, the first accessory device includes one or both of a laser sight and a reflex sight.

In certain embodiments, the first accessory device comprises a laser sight with an integrated reflex sight.

In certain embodiments, the first accessory device comprises an orientation sensor configured to detect one or both of a firearm aiming direction and firearm cant.

In certain embodiments, the program of instructions comprises a friend-foe module for comparing a firearm aiming direction with a known position of one or more allied team members.

In certain embodiments, the weapon system further includes an optical range finder.

In certain embodiments, the weapon further includes a flashlight with an integral optical range finder.

In certain embodiments, the processor is configured to adjust an associated laser sight based on a distance to target.

In certain embodiments, the optical range finder is configured to communicate the distance to target to the first accessory device via the powered accessory rail interface.

In certain embodiments, the weapon system further includes a third accessory device, the third accessory device configured to receive electrical power over the powered accessory rail interface.

In certain embodiments, the third accessory device is a camera.

In certain embodiments, the camera is selected from the group consisting of a thermal camera, a CMOS camera, and a SWIR camera.

In certain embodiments, the weapon system further includes a pivot platform removably attachable to the upper accessory rail, the pivot platform for retaining the third accessory device, the pivot platform having a hinged mounting member pivotal between a first, operative position wherein the third accessory device is aligned with the first accessory device and a second, stowed position, wherein the third accessory device is moved out of alignment with the first accessory device.

In certain embodiments, the power supply is a battery box electrically coupled to the lower accessory rail.

In certain embodiments, the weapon system further includes a battery level circuit for determining a charge level of one or more batteries located in the battery box.

In certain embodiments, the weapon system further includes an RF transceiver.

In certain embodiments, the RF transceiver is a Bluetooth transceiver.

In certain embodiments, the weapon system further includes a first RFID reader.

In certain embodiments, the first RFID reader is located in the battery box.

In certain embodiments, the weapon system further includes one or ammunition magazines, each of the one or more ammunition magazines having an RFID chip readable by the RFID reader, the RFID chip configured to transmit information representative of ammunition type to the first RFID reader.

In certain embodiments, the power supply is housed within a pistol grip of the firearm.

In certain embodiments, the weapon system further includes a remote programming fob configured to transmit one or more user program settings to the weapon system via an RF transceiver.

In certain embodiments, the remote programming fob is programmable with one or more of a computer, laptop, and mobile computing device.

In certain embodiments, the weapon system is programmable via the RF transceiver with one or more of a computer, laptop, and mobile computing device.

In certain embodiments, the weapon system further includes a second RFID reader.

In certain embodiments, the weapon system further includes a tactical glove with a RFID chip readable by the second RFID reader, the RFID chip configured to transmit user-identifying information to the second RFID reader.

In certain embodiments, the weapon system further includes a safety mechanism housed within the pistol grip, the safety mechanism configured to prevent operation of the firearm when the tactical glove with RFID chip is not in proximity to the second RFID reader.

In certain embodiments, the safety mechanism includes a plunger and a solenoid configured to selectively lock and unlock a trigger mechanism of the firearm.

In certain embodiments, the pistol grip further comprises a battery level circuit for determining a charge level of one or more batteries located within the pistol grip.

In certain embodiments, the pistol grip includes one or more user input devices for controlling operation of the weapon system, the one or more user input devices selected from the group consisting of one or more buttons, a keypad, a rotary encoder, or any combination thereof.

In certain embodiments, the weapon system further includes one or more sensors on the barrel for sensing one or more of: barrel temperature, barrel strain, a projectile being fired, and a velocity of the projectile.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
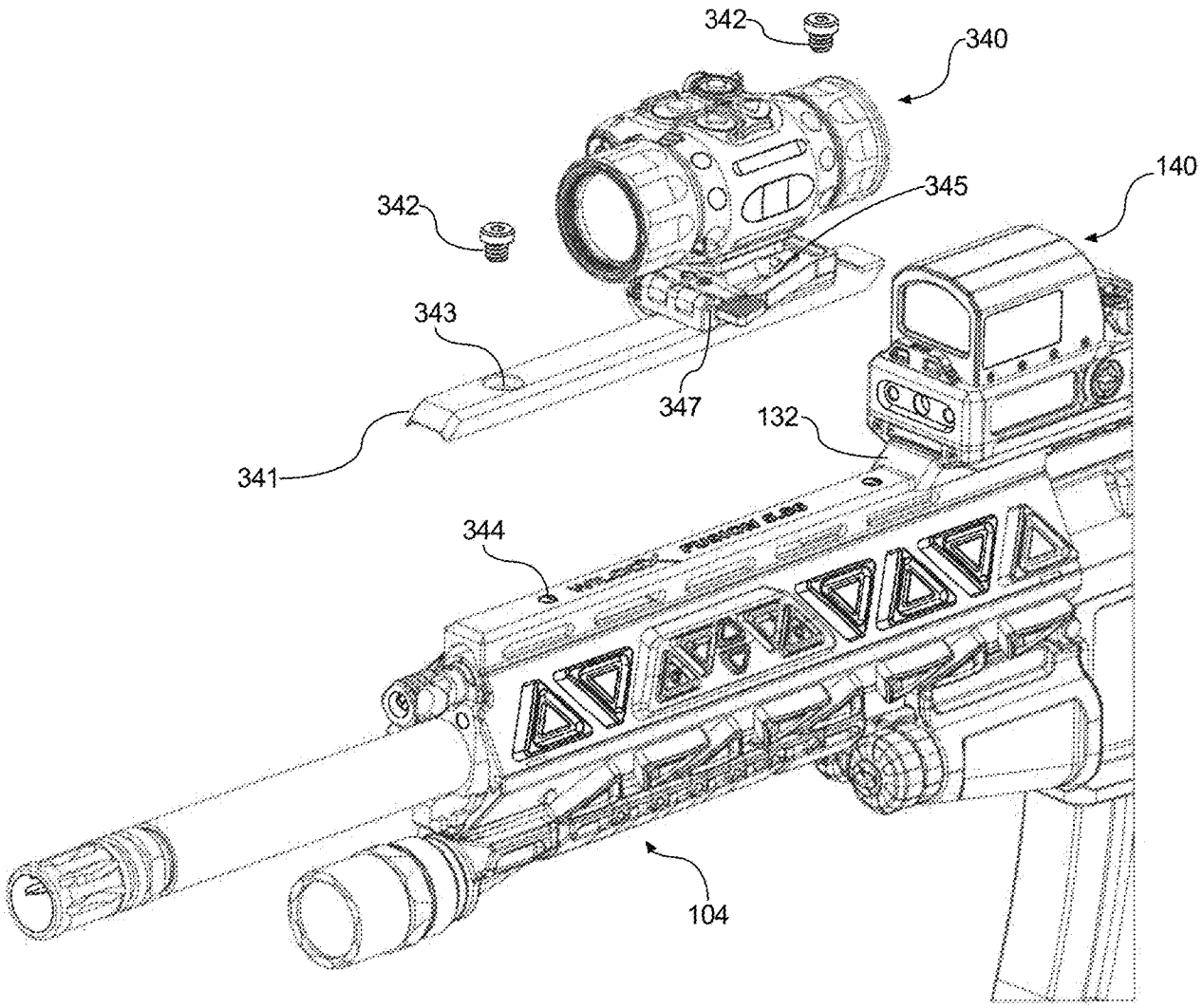
FIG. 1 is an isometric, partially exploded fragmentary view of an exemplary weapon system in a configuration having first and second accessory devices.
Figure 2:
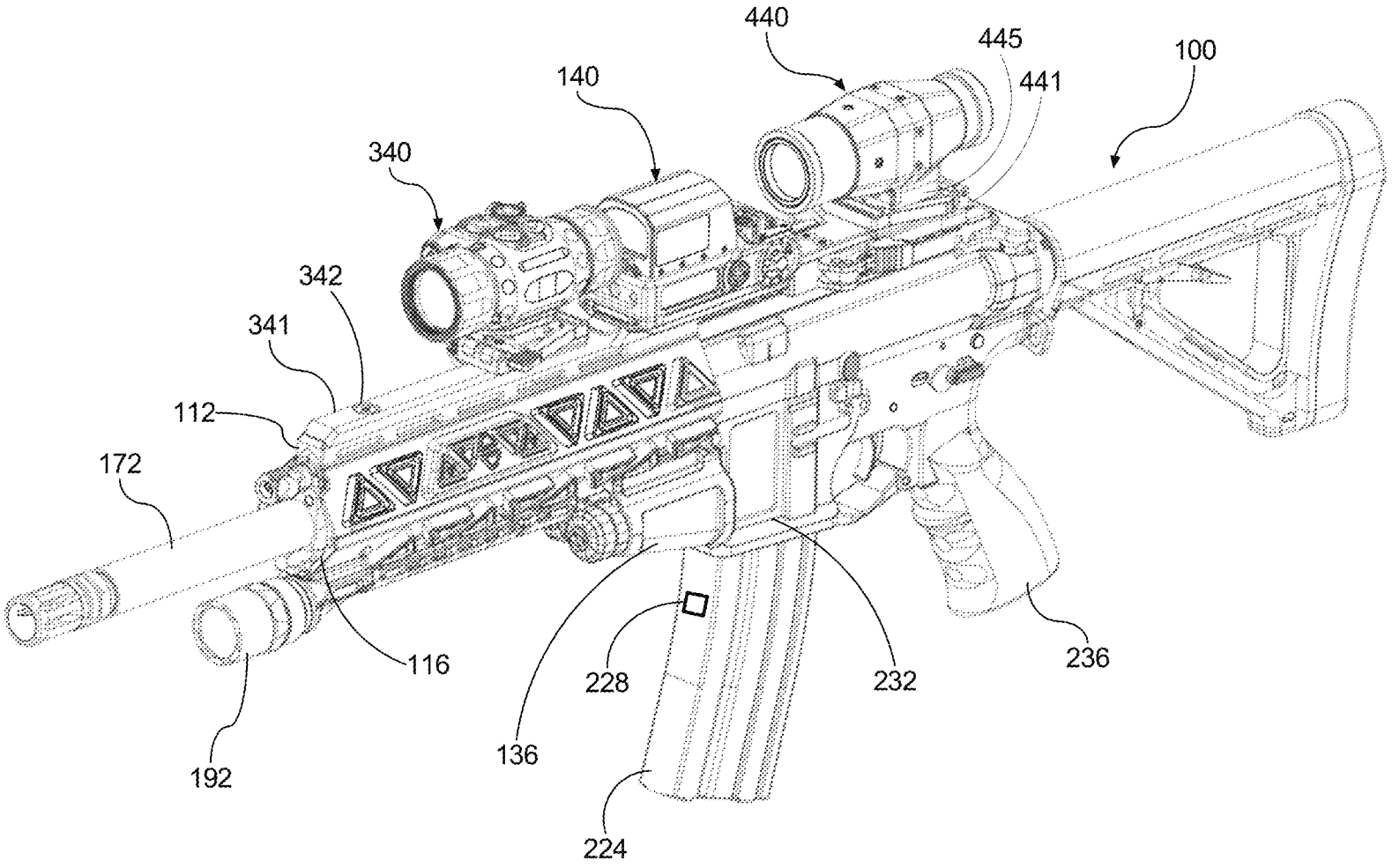
FIG. 2 is an isometric view of the weapon system appearing in FIG. 1, including the first and second accessory devices, and further including an optical scope or magnifier.
Figure 3:
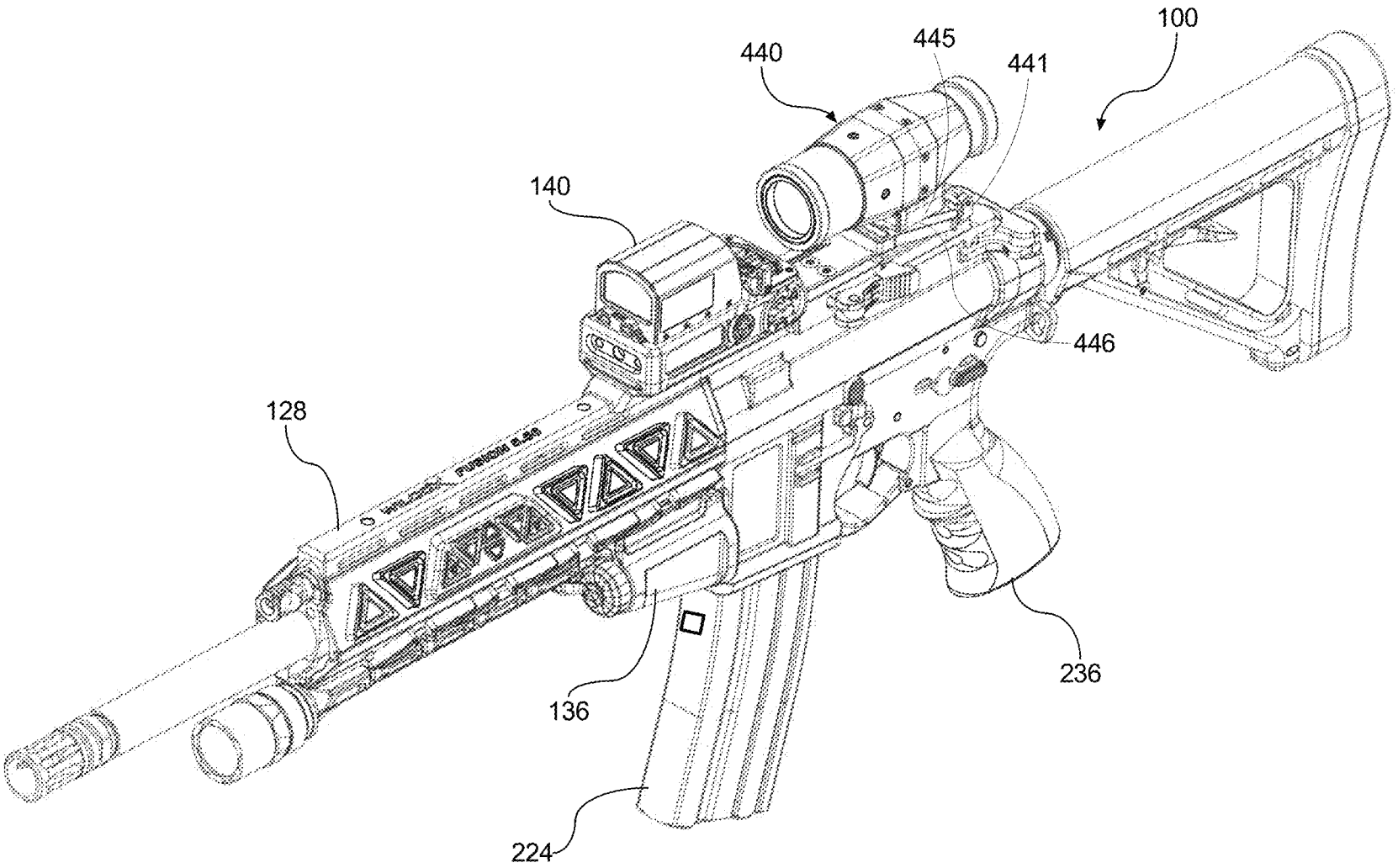
FIG. 3 is an isometric view of the weapon system appearing in FIG. 1, including the first accessory device and the optical scope or magnifier.

Referring now to the drawings, wherein like reference numerals are used to denote like components throughout the several views, the present development relates to a weapon system for use in connection with a weapon such as a firearm 100 and includes a powered accessory rail or platform 104. In certain embodiments, the powered accessory platform 104 includes a handguard assembly 108 including an upper handguard portion 112 and an opposed lower handguard portion 116, wherein the upper handguard portion 112 and the lower handguard portion 116 cooperate to define a sleeve, the sleeve having a proximal end configured to attach to the weapon 100 and a distal end opposite the proximal end. The weapon system is configured to sense, receive, and process data to adjust and compensate for weapon performance, for example, to compensate for barrel whip, temperature, harmonic characteristics, etc.

The handguard assembly 108 is configured to surround at least a portion of the weapon 100 when the proximal end is attached to the weapon. An electrical circuit 126 is disposed within the sleeve defined by the handguard assembly 108. In certain embodiments, the electrical circuit 126 includes a flexible circuit comprising one or more circuit elements, including printed circuit elements, disposed on a flexible circuit substrate. In certain embodiments, the electrical circuit is configured to electrically couple one or more electrically operated devices to a power supply and to provide a data and control signal interface between attached units. A suitable electrical circuit 126 is disclosed in commonly owned U.S. Patent Application Publication No. US2017/0205202 published Jul. 20, 2017 (Ser. No. 15/404,505 filed Jan. 12, 2017), which is incorporated herein by reference in its entirety.

In certain embodiments, an accessory mounting rail 128 is located on a top portion of the upper handguard portion 112, the mounting rail 128 having at least one electrical connector thereon. In certain embodiments, an accessory mounting pad 132 is mechanically and electrically coupled to the accessory mounting rail 128 and electrically couples to a power supply 136 removably attached to the accessory platform 104. An accessory device 140 is mechanically and electrically coupled to the accessory mounting pad 132.

In certain embodiments, the powered accessory rail or platform 104 may be of the type disclosed in commonly owned U.S. Patent Application Publication No. US2016/0327371 published Nov. 10, 2016 (Ser. No. 15/146,094 filed May 4, 2016), which is incorporated herein by reference in its entirety, or the aforementioned commonly owned U.S. Patent Application Publication No. US2017/0205202.

The accessory device 140 is removably attachable to the accessory mounting pad 132 on the accessory platform 104. In certain embodiments, the accessory device 140 is a laser sight. In certain embodiments, the laser sight includes multiple lasers. In certain embodiments, the laser sight includes an integral reflex sight. In certain embodiments, the laser module may be of the type disclosed in commonly owned U.S. Patent Application Publication No. US2016/0102943 published Apr. 14, 2016 (Ser. No. 14/881,779 filed Oct. 13, 2015), which is incorporated herein by reference in its entirety.

In certain embodiments, a second accessory device 340 is removably attached to a pivot platform 341 which is located on the accessory mounting rail 128. In certain embodiments, the pivot platform 341 is removably attached to the accessory mounting rail by means of one or more threaded screws 342, which are threaded through one or more threaded openings 343 in the pivot platform 341, corresponding with one or more threaded openings 344 in the accessory mounting rail 128. The second accessory device 340 may be a camera, such as a thermal camera, complementary metal-oxide-semiconductor (CMOS) image sensor, or short wave infrared camera (SWIR), although other accessory devices are contemplated. The second accessory device 340 includes a dovetail mounting shoe 345 configured to be received in a mounting shoe receiver 346 of the pivot platform. In certain embodiments, the pivot platform is mechanically and electrically coupled to the accessory mounting rail 128 and power supply 136.

The pivot platform includes a pivot or hinge mechanism 347, which allows the second accessory device 340 to be pivotally adjusted from a first position substantially on top of the pivot platform to a second position substantially to the side of the pivot platform. In certain embodiments, when the second accessory device 340 is in the first position, the second accessory device 340 is coaligned with the first accessory device 140 such that the first and second accessory devices may be used together in single operation. In certain embodiments, the pivot platform includes a lock or clamp device holding the second accessory device 340 in place in the first position. A release mechanism is included such that activation of the release allows the second accessory device 340 to be movable to a second or stowed position. In certain embodiments, when the second accessory device is moved from the second, stowed position to the first, operative position, the second accessory device 340 receives power from power supply 136. In certain further embodiments, a switch is provided such that when the second accessory device 340 is moved from the first, operative position to a stowed position, the second accessory device does not receive power from power supply 136. The switch may be a mechanical switch or a proximity switch, e.g., employing a magnet element and a proximity sensor such as a magnetic reed switch or a Hall effect sensor.

In certain preferred embodiments, the laser sight includes a laser module 144 having one or more lasers, including for example, a visible target pointer laser 148, an infrared (IR) target pointer laser 152, and an IR illuminator or flood light laser 156. In certain embodiments, the lasers 148, 152, and 156 are factory co-aligned on an optical bench and potted with a potting compound during manufacture to maintain the co-aligned state.

In certain embodiments, the accessory device 140 further includes an integrated reflex sight 160. In certain embodiments, the reflex sight 160 is co-aligned with the laser module 144.

In certain embodiments, the accessory device 140 includes a processor 164 and an associated electronic memory 168. In certain embodiments, the memory 168 includes a program of instructions executed by the processor 164 for performing ballistics calculations based on, e.g., distance to a target, ammunition type, and other factors, by automatically adjusting the sight to assist the user in aligning the barrel 172 of the weapon 100 to achieve a firing trajectory which will cause the path of a projectile fired by the weapon 100 to intersect with the position of a desired target. In certain embodiments, the firing trajectory is adjusted based on the processor's calculations, via a stepper motor and a wedge. The stepper motor selectively advances or retracts a wedge that changes the bias of the laser bench, thereby adjusting the angle of the sight trajectory. One stepper motor/wedge may be provided to provide an elevation adjustment and another stepper motor/wedge may be provided to provide a lateral (windage) adjustment.

In certain embodiments, the trajectory is automatically adjusted based on one or both of (a) the type of ammunition installed; and (b) the distance detected with a range finder component as will be described below.

In certain embodiments, the memory 168 includes a program of instructions executed by the processor 164 for calculating barrel performance.

In certain embodiments, the memory 168 includes a program of instructions executed by the processor 164 for calculating barrel whip.

In certain embodiments, the accessory device 140 includes a human-viewable display 176, such as an LCD display, LED display, etc., and associated display driver electronics, operably coupled to the processor 164.

The processor 164 is configured to receive data or signals representative of one or more system parameters, which are logged and stored in the memory 168. In certain embodiments, the system parameters may be any one or more of the following:

1. Round count based on barrel sensor output (described below),
2. Barrel temperature based on barrel sensor (thermocouple) output.
3. Barrel mileage/life expectancy based on barrel sensor output
4. Rate of fire, e.g., measured in rounds per minute (RPM), based on barrel sensor output.
5. Bullet velocity based on barrel sensor output.
6. Laser mode, e.g., visible, IR, IR Flood, IR+IR Flood.

7. Ammunition cartridge type, including: training rounds (e.g., blanks or non-lethal ammunition rounds), low velocity rounds (e.g., 300 AAC Blackout subsonic rounds), high velocity rounds (e.g., 300 AAC Blackout supersonic rounds), and so forth, based on a radio frequency identification (RFID) tag associated with an installed ammunition magazine.

8. Cant/Tilt function based on an orientation sensor 180, which may be, e.g., an accelerometer, inclinometer, or the like. A visual indication of the degree of firearm cant or tilt may be output to the display 176 to assist the shooter in leveling the firearm 100 or be used to determine the direction in which the firearm is pointed. For example, aiming direction information may be used in cooperation a gun lock mechanism, the orientation sensor 180 may be used as an active friend-or-foe system.

9. Battery power remaining (state of charge), e.g., based on output signal from a battery consumption or monitoring circuit 184, such as a Coulomb counter, battery fuel gauge integrated circuit, voltmeter for measuring battery output voltage or voltage drop due to battery internal resistance, and the like. In certain embodiments, battery state of charge information is stored in a battery power database 320 in the memory 168. A visual indication of the battery life remaining, e.g., as a percentage based on an estimated battery life, may be output to the display 176.

Figure 4:
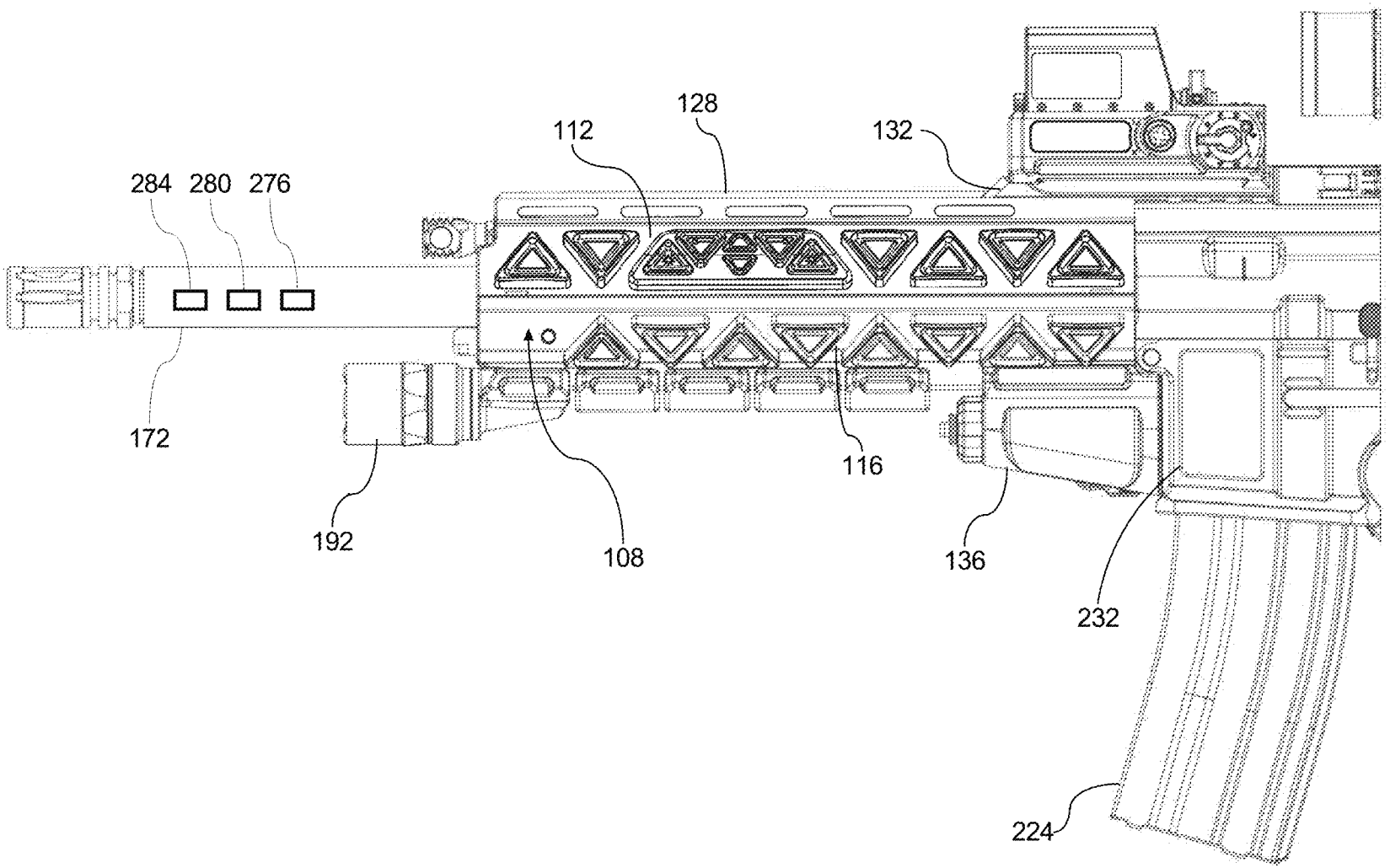
FIG. 4 is a fragmentary side view of the weapon system configuration appearing in FIG. 3.
Figure 5:
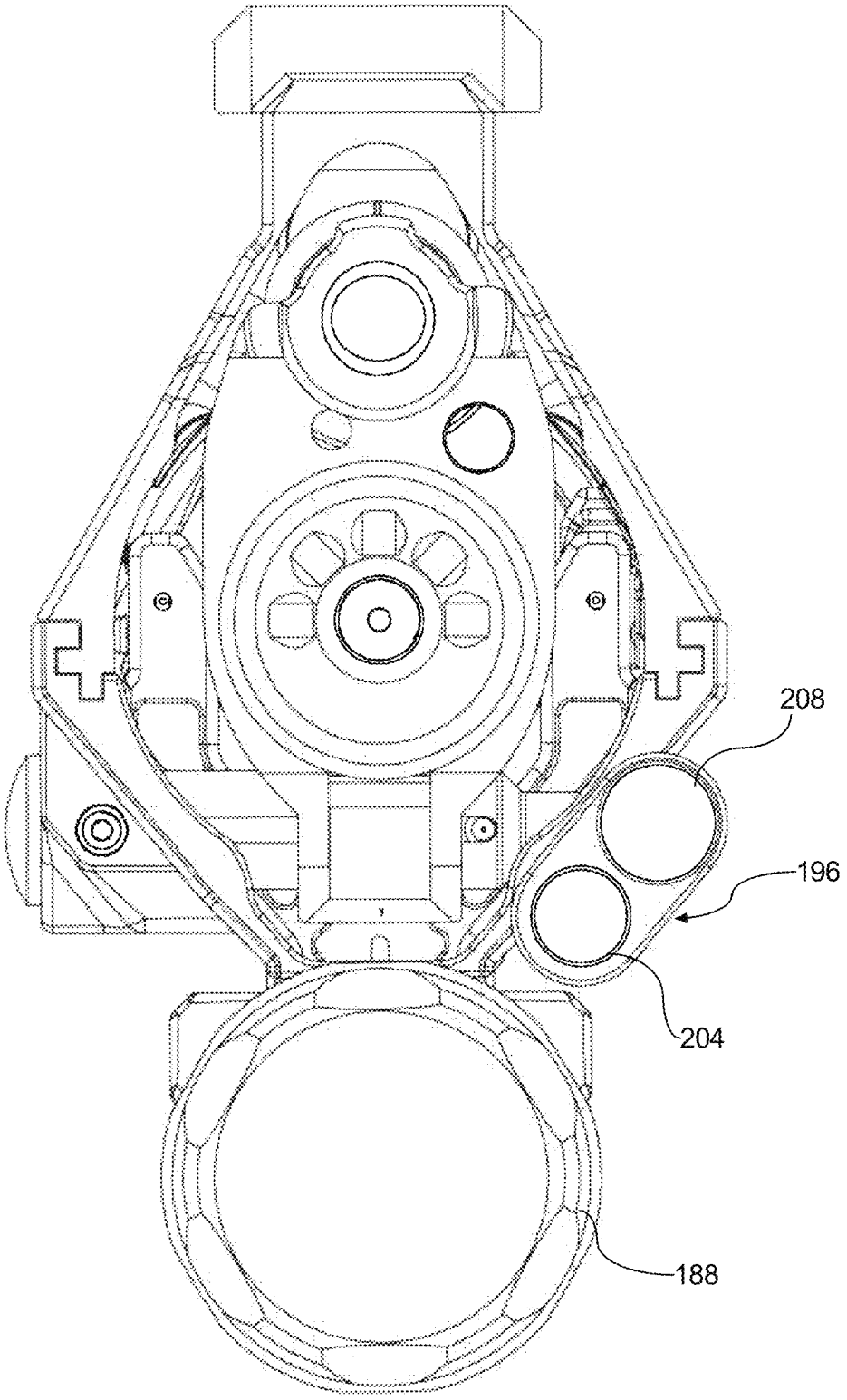
FIG. 5 is a front elevation view of the fore end portion of the illustrated weapon system.
Figure 6:
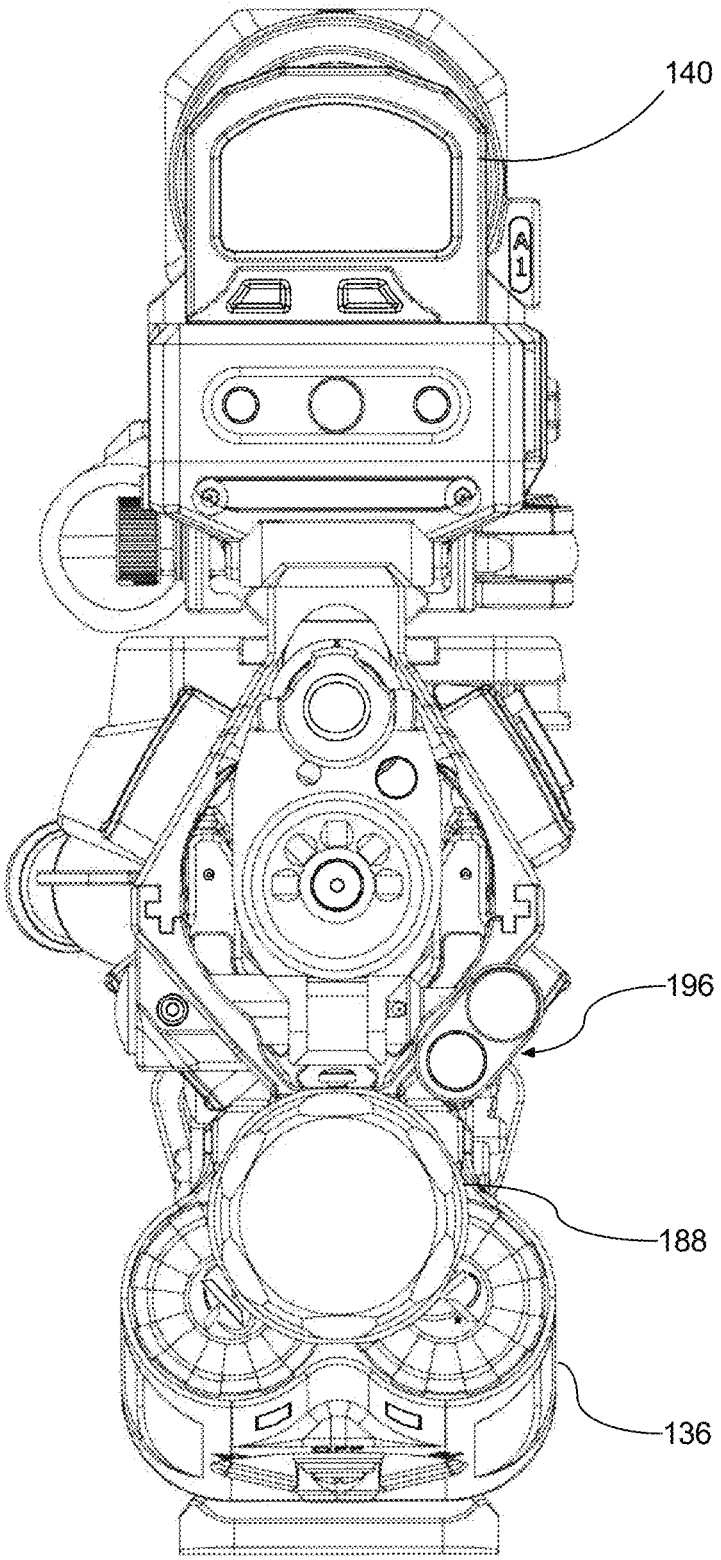
FIG. 6 is a front elevation view of the weapon system configuration appearing in FIGS. 3 and 4 with the magazine removed.
Figure 7:
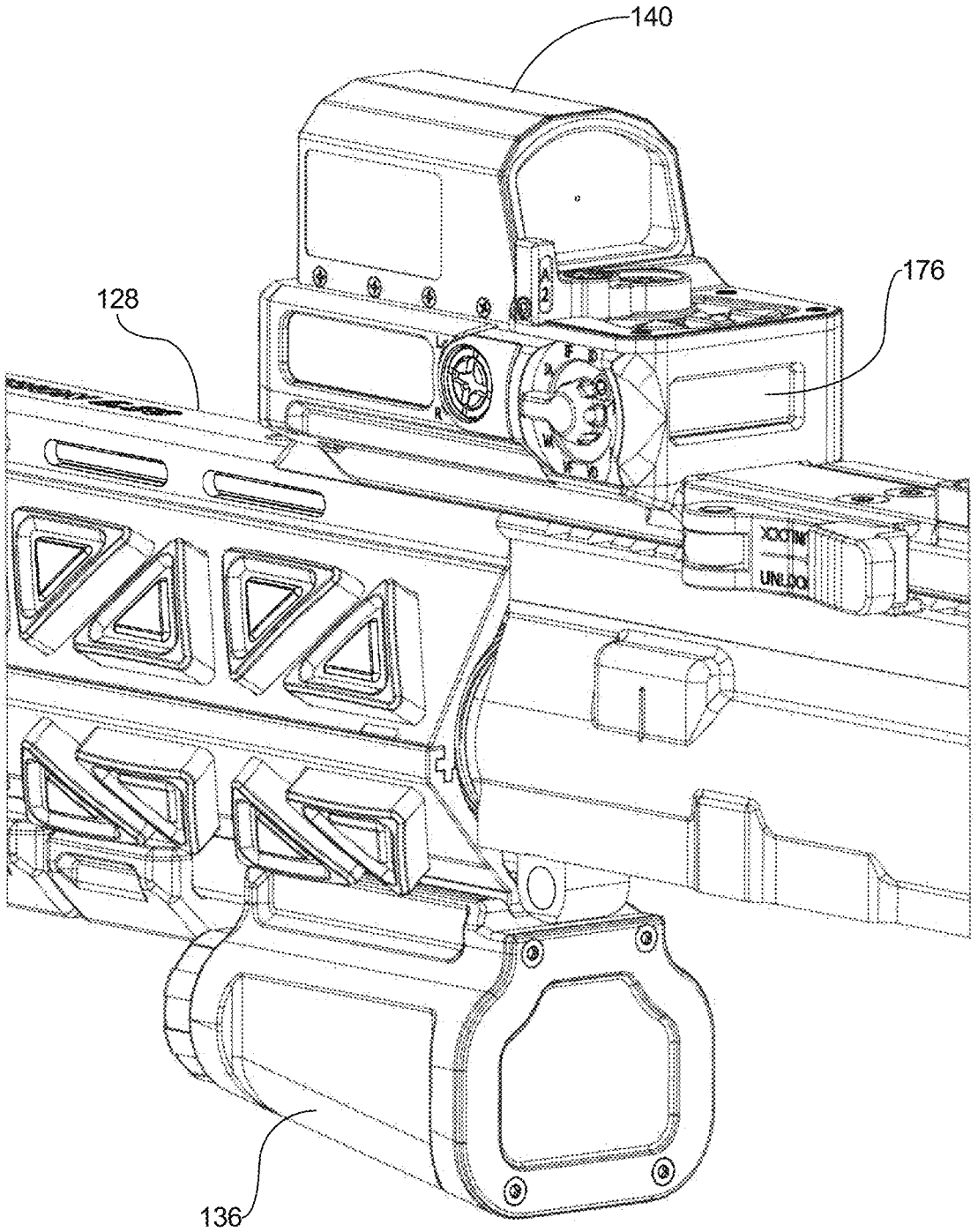
FIG. 7 is a fragmentary isometric view taken generally from the rear and left side.

10. Barrel whip based on barrel sensor output and barrel harmonic characteristics associated with ammunition cartridge type, barrel length, temperature, and the like. In certain embodiments, barrel information is logged in a barrel whip database 328 stored in the memory 168. With reference to FIG. 4, bullet/projectile placement varies as a function of (1) the position/alignment of the barrel in relation to the sight that is used to aim the weapon and (2) barrel whip and in particular, the location of the last 120 mm of the barrel as the bullet/projectile exits the barrel. Barrel whip characteristics change as a function of barrel conditions. For example, as the barrel heats up, the barrel droops more, thereby changing the position of the barrel. Shooting the weapon also changes the barrel position. One or more strain gauges monitor such barrel conditions.

11. Distance to target, which may be obtained from a range finder, e.g., an optical range finder integral with the accessory device 140 (not shown) or a separate range finder associated with the weapon system and in communication with the weapon system herein which communication may be via a wired or wireless communication interface. In certain embodiments, the distance to target is logged in a database 324 stored in the memory 168 and may be selectively displayed as an item of information on the display 176.

In certain embodiments, the distance to target is determined using a rangefinder 196 associated with a flashlight module 188. The flashlight module 188 is attached at the distal end of the lower handguard member and is electrically coupled to the power supply 136 via the circuit 126. The flashlight module includes a flashlight head portion 192 and an optical range finder 196. A mounting member 200 provides a removable electrical and mechanical connection to the lower handguard member 116.

The flashlight head 192 includes one or more light emitting elements, preferably LEDs. In certain embodiments, the flashlight head 192 includes one or more LEDs which emit radiation in a visible portion of the electromagnetic spectrum. In other embodiments, the flashlight head 192 includes one or more LEDs which emit radiation in an infrared portion of the electromagnetic spectrum. In still further embodiments, the flashlight head 192 is a dual mode flashlight which includes one or more LEDs for selectively emitting radiation in a visible portion of the electromagnetic spectrum and one or more LEDs for selectively emitting radiation in an infrared portion of the electromagnetic spectrum.

In certain embodiments, the range finder 196 comprises a laser emitter 204 and an optical sensor or receiver 208. The laser 204 sends a beam toward an intended target and reflections of the beam from the target object are detected by the optical receiver 208. The distance to the target is calculated based on the time-of-flight of the laser beam. In certain embodiments, the laser 204 emits a laser beam in a very short series of pulses, which may be encoded to assist the detector 208 in recognizing the reflected signal.

In certain embodiments, range finder 196 operates as an optical switch to automatically adjust the trajectory of the sight 140 between a "Close Quarter Battle" (CQB) setting and an "Over the Beach" (OTB) setting, under programmed control of the processor 164, depending on whether the target is within some predetermined threshold value, e.g., some value between 5 and 20 meters, preferably between 5-10 meters, most preferably 10 meters. In certain embodiments, if the trajectory of the sight is set in the OTB setting and the range finder 196 detects that the target is within such predetermined distance, the trajectory of the sight is adjusted to the CQB setting. In certain embodiments, if the trajectory of the sight is set in the CQB setting and the range finder 196 detects that the target is at a distance greater than the predetermined distance, the trajectory of the sight is adjusted to the OTB setting.

Power may be supplied to the accessory device(s) 140 and 240, flashlight module 188, or other attached electrically operated devices by one or more of an internal or dedicated power supply for each device, or alternatively or additionally, one or both of the battery box 136 attached to the accessory platform 104 and a power supply 123 contained within a pistol grip 236. In certain embodiments, the power supply 136 is a battery box as described in the aforementioned commonly owned U.S. Patent Application Publication No. US2017/0205202.

The power supply(ies) includes one or more batteries. In certain embodiments, the power supply includes an RFID reader. In certain embodiments, the power supply 136 includes an RF transceiver interface, such as a Bluetooth transceiver 222. In certain embodiments, the handgrip 236 includes an RF transceiver interface, such as a Bluetooth transceiver 253.

In certain embodiments, a third accessory device 440 is removably attached to a rear pivot platform accessory mount 441, which is located on the firearm upper receiver behind the pivot platform 341. In certain embodiments, the rear pivot platform 441 is removably attached to the firearm upper receiver by means of one or more threaded fasteners (not shown), which engage one or more aligned threaded openings rear pivot platform 441 and a corresponding one or more threaded openings in the firearm upper receiver. The third accessory device 440 may be an optical device such as an optical magnifier or optical scope. In certain embodiments, the third accessory device 440 is an optical magnifier, e.g., a 3× or 4× optical magnifier, to provide an enlarged view of the integrated reflex sight. The third accessory device 440 includes a dovetail mounting shoe 445 configured to be received in a mounting shoe receiver 446 of the rear pivot platform 441. In certain embodiments, the rear pivot platform is mechanically and electrically coupled to the accessory mounting rail 128 and power supply 136.

The rear pivot platform includes a pivot or hinge mechanism 447, which allows the third accessory device 440 to be pivotally adjusted from a first position in optical alignment with the first accessory device 140 wherein to a second position wherein the third accessory device 440 is moved out of optical alignment with the first accessory device 140. In certain embodiments, when the third accessory device 340 is in the first position, the third accessory device 440 is coaligned with the first accessory device 140 such that the first and second accessory devices may be used together in single operation. Similarly, in certain embodiments wherein both the second accessory device 340 and the third accessory device 440 are attached and in their respective first or operative positions, the first, second, and third accessory devices (140, 340, 440) are coaligned with the first accessory device 140 such that the first, second and third accessory devices may be used together in single operation.

In certain embodiments, the pivot platform includes a lock or clamp device holding the third accessory device 440 in place in the first position. A release mechanism is included such that activation of the release allows the third accessory device 440 to be movable to the second, stowed position.

Figure 12:
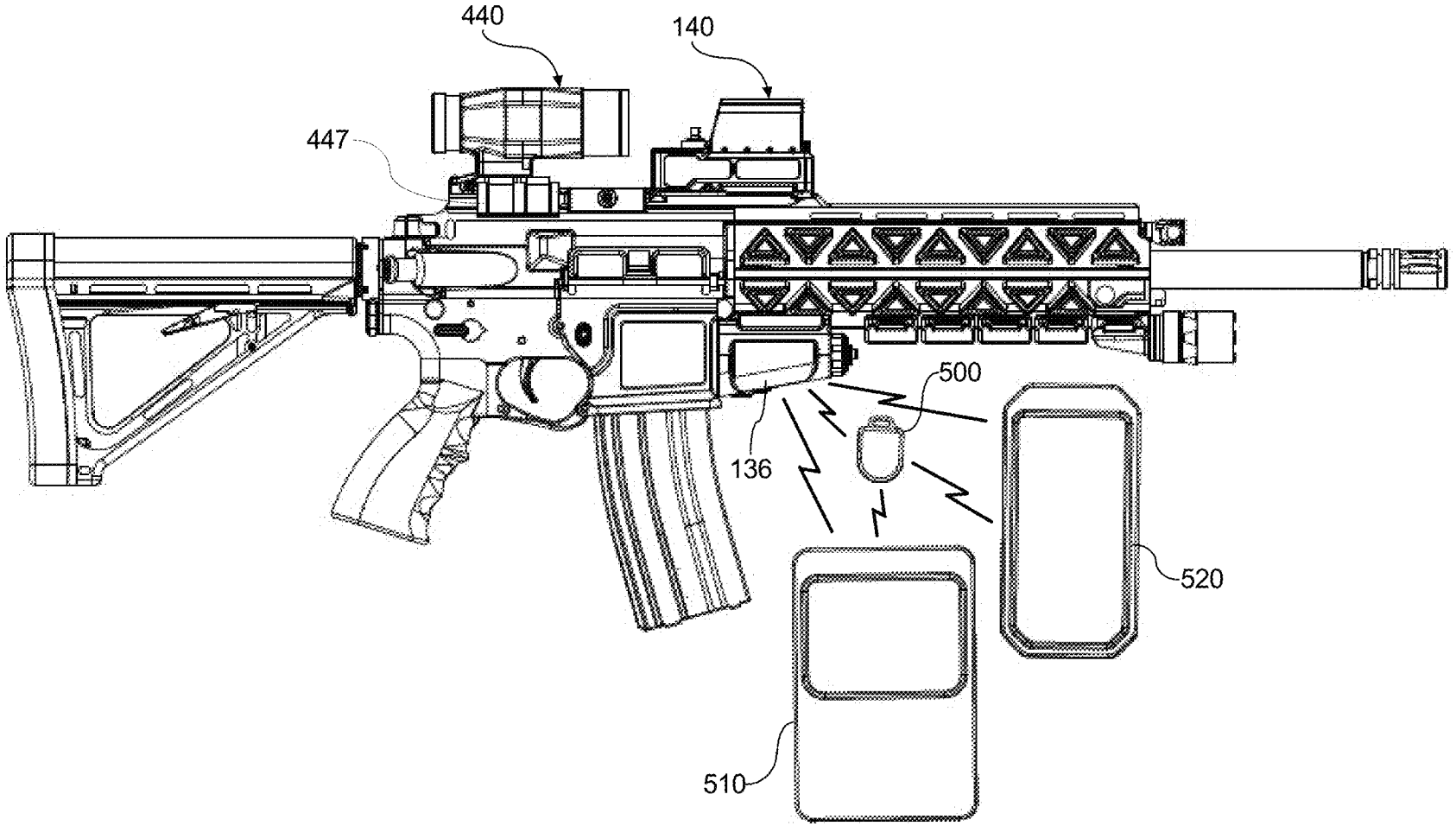
FIG. 12 is a side view of the configuration appearing in FIGS. 3 and 4 and further including a programming fob for programming the weapon system in accordance with the user's preferences or custom settings and one or more mobile devices for programming the fob and/or for programming the weapon system directly.
Figure 13:
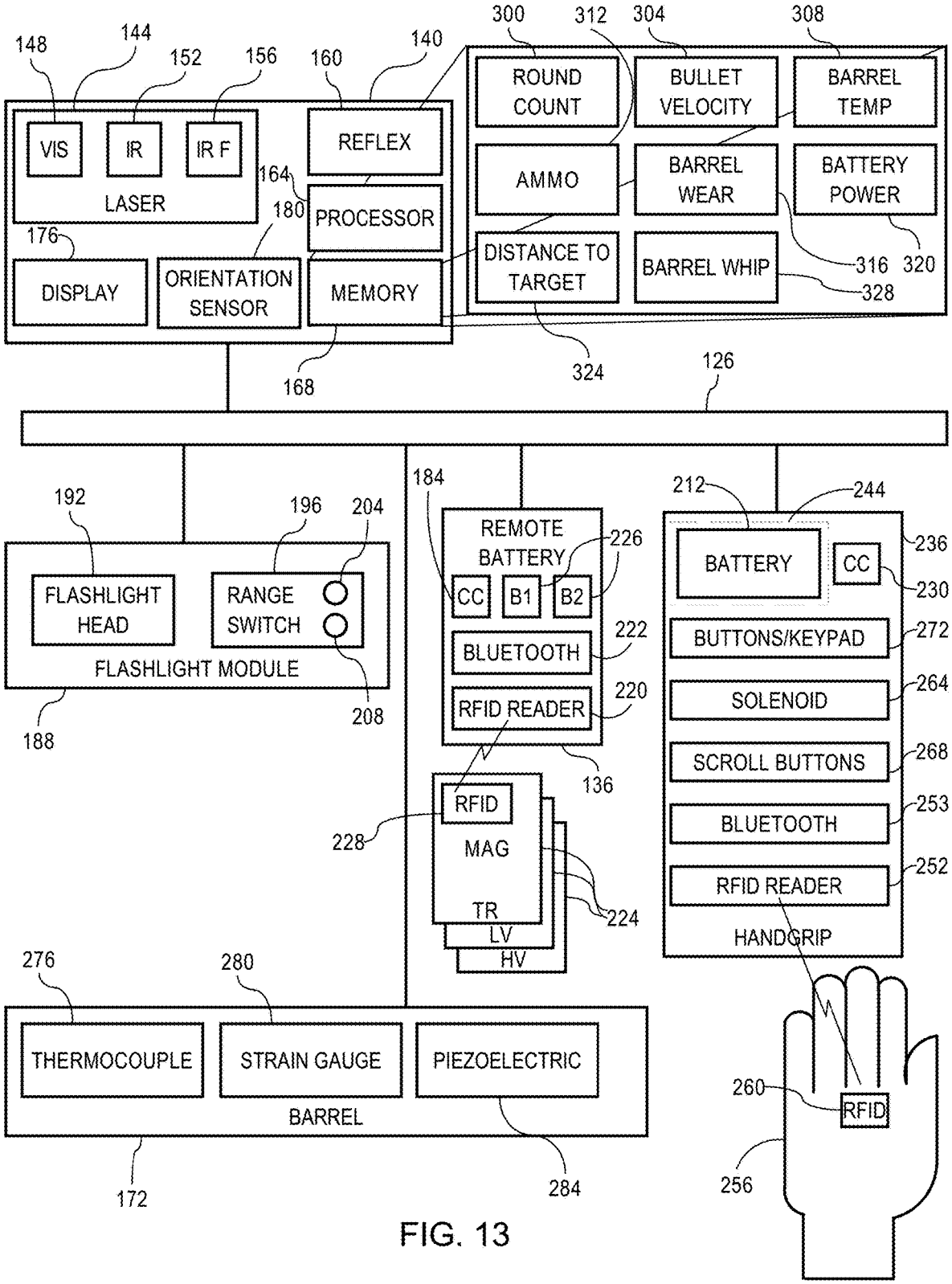
FIG. 13 is a block diagram illustrating an exemplary weapon system in accordance with the present disclosure.
Figure 14:
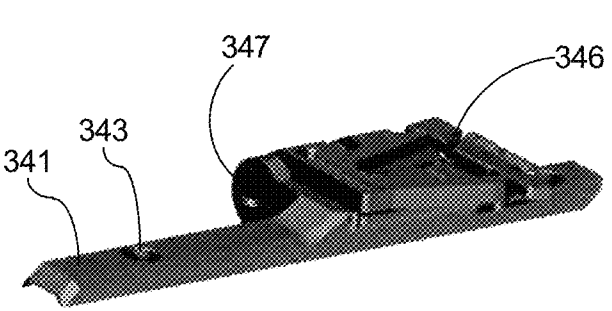
FIG. 14 is an isometric view of the pivot platform.
Figure 15:
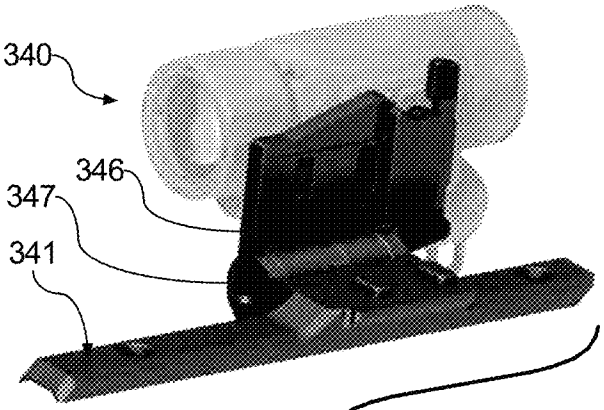
FIG. 15 is an isometric view of the pivot platform with an accessory device (e.g., camera) attached to the pivot platform and pivoted out of the line of sight.
Figure 16:
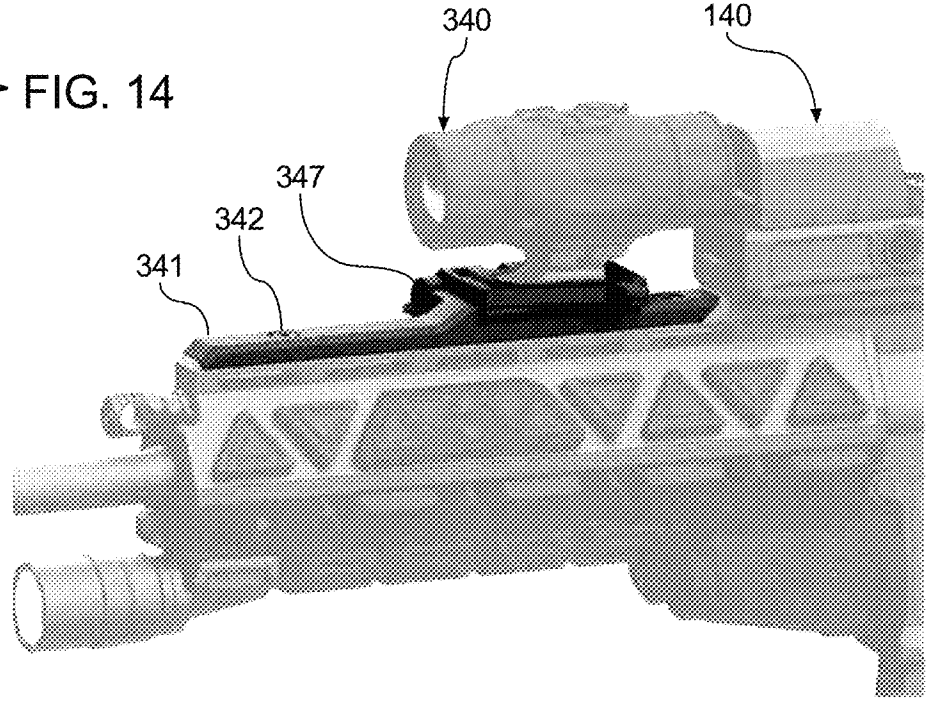
FIG. 16 is a fragmentary view of the firearm with a second accessory device on the pivot platform in optical alignment with a first accessory device.
Figure 17:
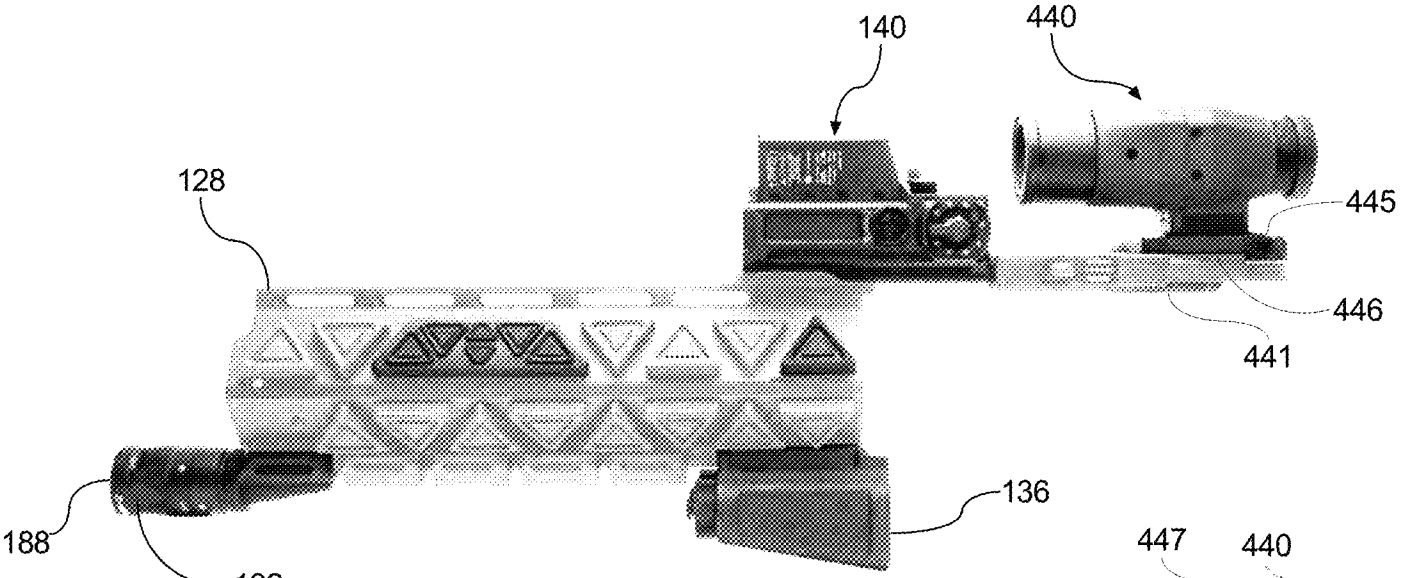
FIG. 17 is a fragmentary side view of the weapon system herein with the firearm and pivot platform removed, and further having a third accessory device (e.g., optical scope or magnifier) positioned behind and in optical alignment with the first accessory device (e.g., laser pointer with integral reflex sight).
Figure 20:
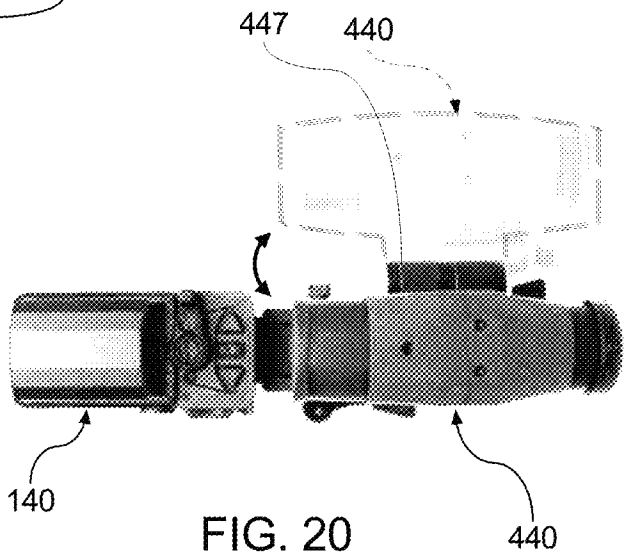
FIG. 20 is a top view illustrating the first and third accessory devices.
Figure 19:
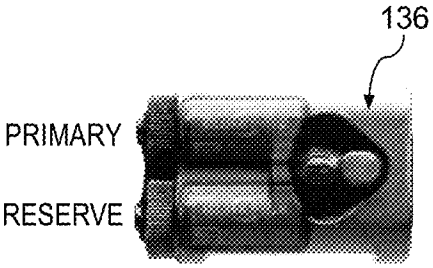
FIG. 19 is a bottom view of an exemplary battery box configured to provide electrical power to an accessory device remotely located on the weapon system.
Figure 18:
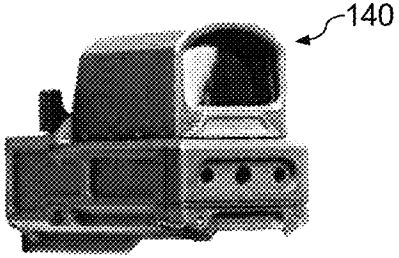
FIG. 18 is an isometric view of an exemplary accessory device.

As illustrated in FIG. 12, certain embodiments of the weapon system includes a fob, e.g. key chain type fob, or other portable associated device 500, that is programmable to store user customizable device settings. This avoids the need for the user have to take the time to go through all the programming steps to customize it to the person. For example, a soldier can pick up another soldier's rifle that has different settings, and quickly change it over to his or her settings. Thus, the soldier only needs to worry about picking up a gun and shooting it without the confusion of programming. The cell phone or other mobile device, through an app, can do the programming off line, and then transfer it to the battery box controller, either directly or through a programmable key fob.

The fob 500 includes an RF transceiver interface, such as a Bluetooth transceiver. The fob may be remotely and wirelessly programmed, for example, through a fob programming unit, which may be a dedicated fob programming device 510 or a mobile device such as a cell phone, smart phone, handheld data terminal, etc., to configure and store desired weapon systems settings. The battery box 136 includes a transceiver which is capable of receiving a radio frequency signal emitted by the pre-programmed fob 500. When brought within range of the battery box, the pre-programmed fob 500 transmits the stored custom user settings from the fob 500 to the weapon system and programs the weapon system with the desired settings. In certain embodiments, the fob includes an actuator button for transmitting the settings to the battery box transceiver. In certain embodiments, as an alternative to using the fob 500, the programming device 510 or alternatively the cell phone, smart phone, or hand held data terminal 520, etc. running an application program, is programmed user and is then used to transmit the custom program information or settings directly via the Bluetooth transceiver in the battery box without the fob 500.

In certain embodiments, multiple interchangeable magazines 224 configured for holding different types of ammunition cartridges are provided. In certain embodiments, each magazine 224 has an RFID tag 228 attached thereto. The RF tag 228 may be active, semi-active, or passive and contains stored data representative of the type of ammunition cartridges stored within the magazine 224. In the illustrated embodiment, the RFID reader 220 in the battery box 136 sends signals to and receives signals from the RFID tag 228. However, it will be recognized that the associated RFID reader may be disposed elsewhere, such as on the firearm upper or lower receiver or on the accessory platform 104 or other device attached to the firearm.

The RF reader 220 and RFID tag 228 are capable of sending and receiving electromagnetic signals to and from each other, thereby allowing the reader to interrogate the tag 228 and obtain data representative of the type of ammunition rounds stored in the magazine that is currently inserted into the magazine well 232 of the firearm 100. In certain embodiments, the RFID tag 228 is a passive RF tag which does initiate communications with the RFID reader 220, but must be read, i.e., wherein the RFID tag 228 utilizes power from the RF waves transmitted by the RFID reader 220. In preferred embodiments, the communication range between the RFID reader 220 and the RFID tag 228 is in the range of 0 to 1 meter, preferably 0 to 30 centimeters, and more preferably 0 to 20 centimeters.

Figure 8:
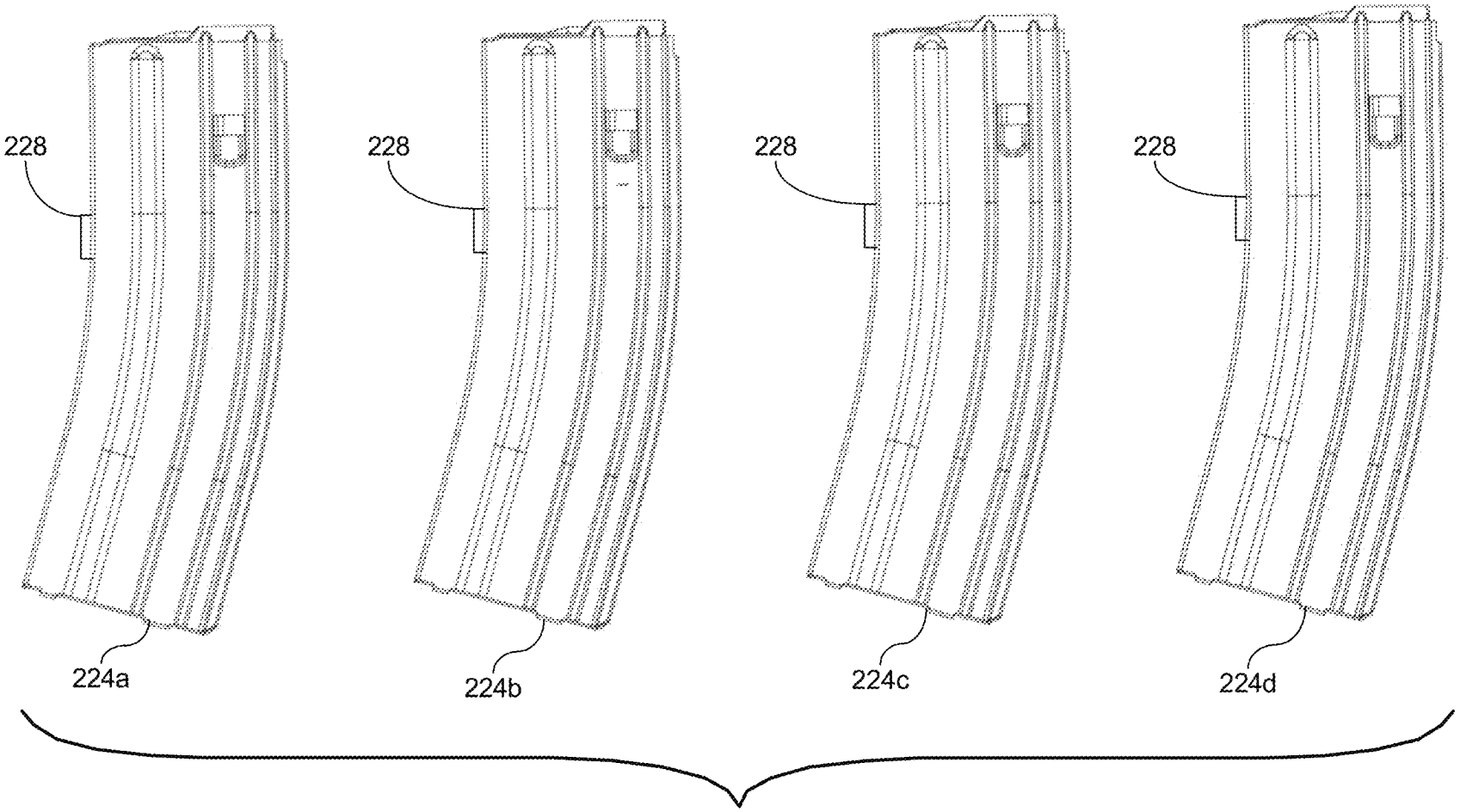
FIG. 8 illustrates a plurality of interchangeable ammunition magazines operable with the present weapon system.
Figure 9:
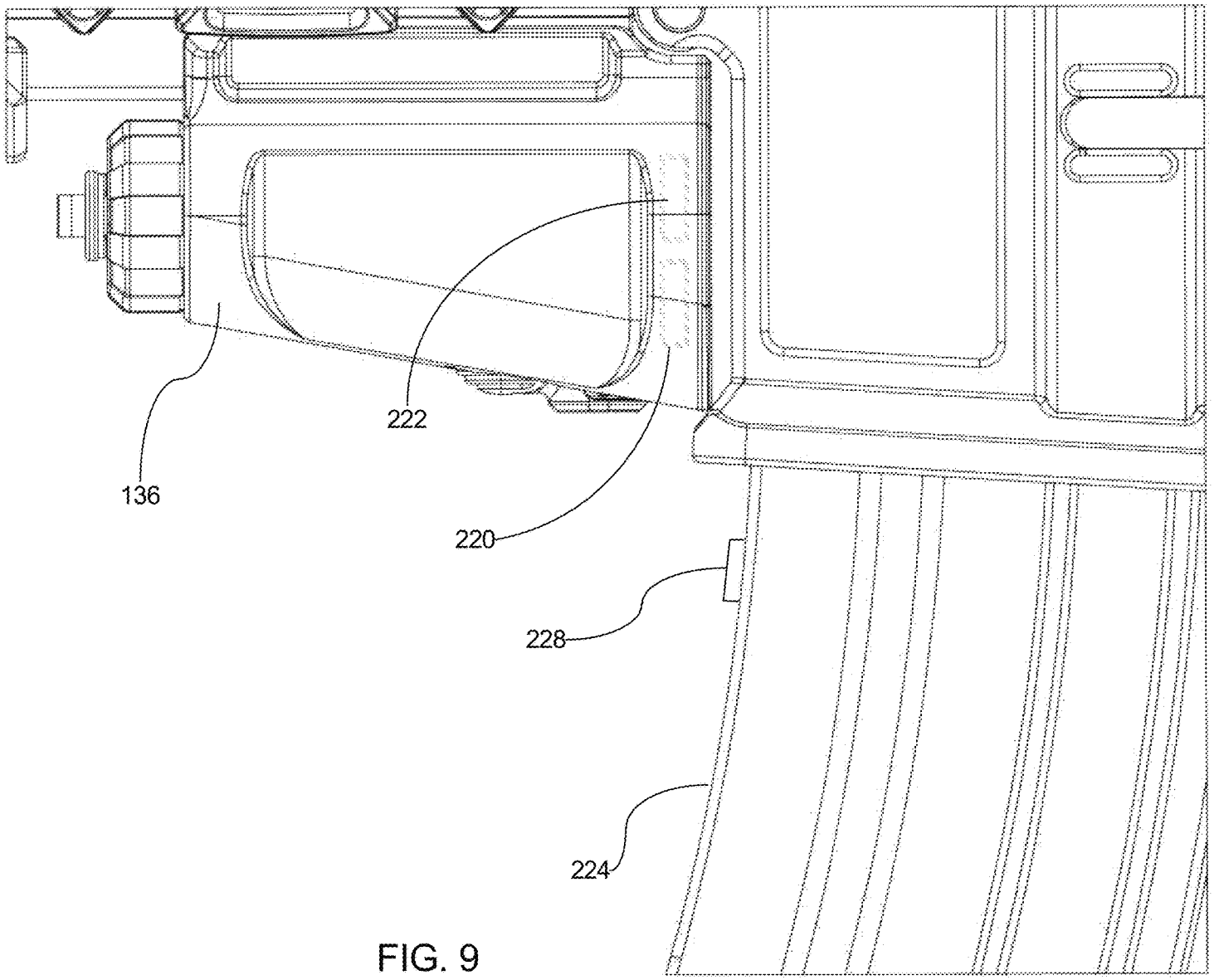
FIG. 9 is an enlarged, fragmentary side elevation view of the weapon system herein having a magazine with RFID tag inserted into the magazine well.
Figure 10:
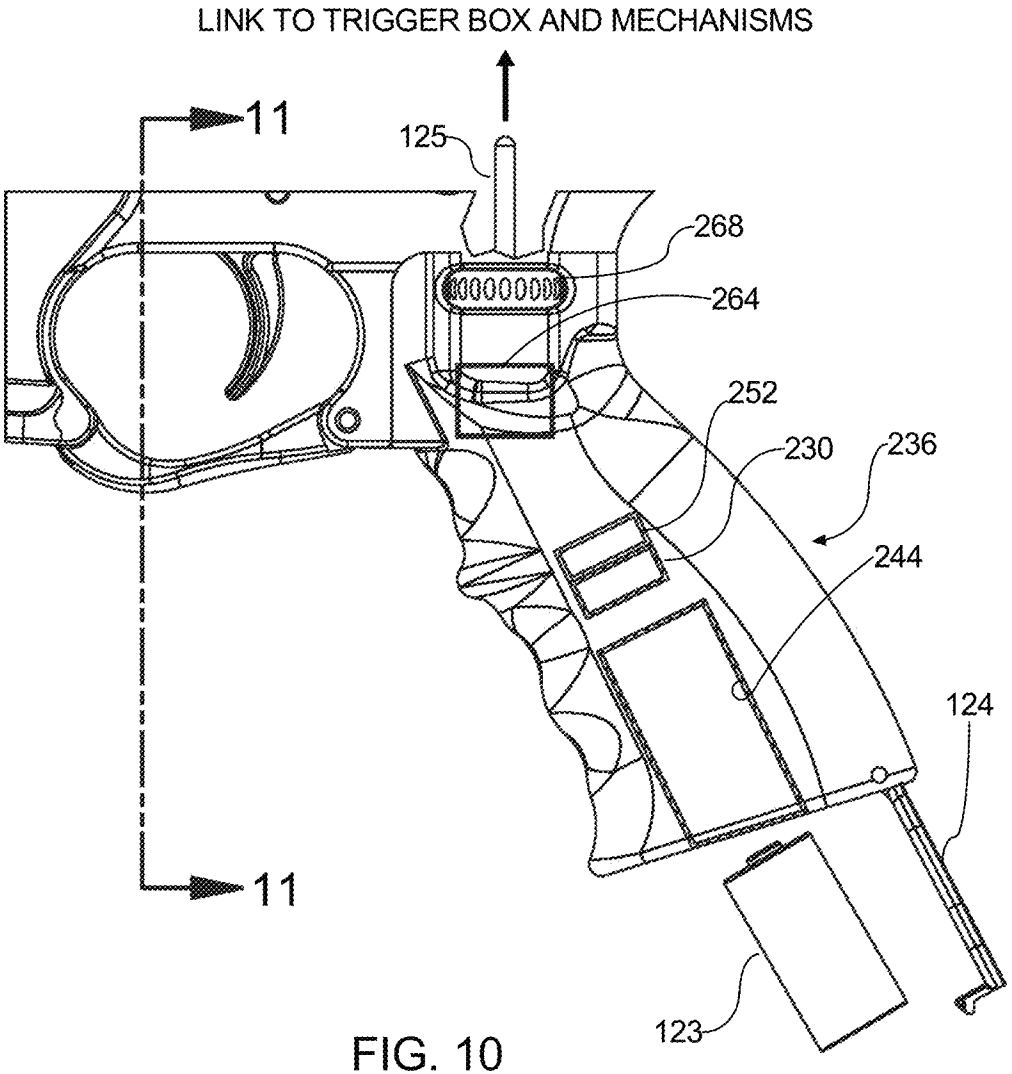
FIG. 10 is an enlarged, fragmentary side view illustrating components of the exemplary weapon system herein within the pistol grip and lower receiver.
Figure 11:
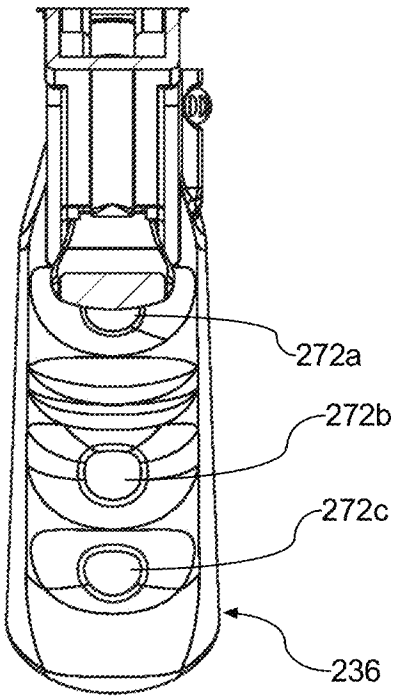
FIG. 11 is a cross-sectional view taken along line 11-11 appearing in FIG. 10.

In certain embodiments, as shown in FIG. 8, first one of the magazines 224*a* is a magazine for low velocity rounds such as low velocity (subsonic) .300 AAC Blackout rounds, and a second one of the magazines 224*b* is a magazine for high velocity (supersonic) .300 AAC Blackout rounds, a third one of the magazines 224*c* is a magazine for saboted rounds, e.g., Sabot Light Armor Penetrator (SLAP) rounds such as .300 ACC Blackout SLAP rounds, and a fourth one of the magazines 224*d* is a magazine for training rounds. It will be recognized that other ammunition types are also contemplated.

In certain embodiments, the ammunition type is logged in an ammunition database 312 stored in the memory 168 and may be displayed to the user on the display 176, e.g., as an item of information accessed by the user using scroll buttons 268 on the handguard assembly 108, as described below.

In operation, the RFID reader 220 reads the data representative of the round type contained on the RFID tag 228 of the installed magazine 224. The data is transmitted via the accessory platform 128 and the circuit 126 to the accessory device 140 and stored in the memory 168. In certain embodiments, environmental sensors 501 collect data regarding various environmental parameters, such as outside temperature, directional orientation, etc. The environmental data is transmitted to the processor 164 and may be stored in the memory 168. The processor 164 then calculates the sight trajectory based on ballistics information for the detected ammunition type as well as other factors, such as the distance to the target as determined using the range finder 196 as described above. In certain embodiments, the firing trajectory is adjusted based on the processor's calculations, via a stepper motor selectively advancing and retracting a bearing against the optical bench of an aligned sighting device.

In certain embodiments, when the installed magazine is a training round, the aiming mark from the reflex sight is configured to appear as a green dot. In certain embodiments, when the installed magazine is a non-training round, the aiming mark from the reflex sight is configured to appear as a green dot. It will be recognized that other reticle shapes, such as rings, cross hairs, and the like, are also contemplated.

In certain embodiments, the handgrip 236 further comprises a power source 123. One or more batteries 123 are received within an interior battery compartment 244 defined in the handgrip 236. In certain embodiments, the handgrip includes a battery cap 124. In certain embodiments, the handgrip 236 is coupled to an RF transceiver, such as the Bluetooth transceiver 222. Circuitry within the compartment 244, which may include circuit elements printed circuit elements on a flexible substrate, electrically couple the terminals of the battery(ies) to circuit within the accessory platform to provide battery power and control signals to attached devices, such as the laser sight 140 and/or camera 340. In certain embodiments, a Coulomb counter or like circuit 230 is provided to output battery state of charge information to the device 140 via the circuit 126.

In certain embodiments, the handgrip 236 includes an RFID reader 252 for sensing the proximity of a tactical glove 256 carrying an RFID chip tag 260. In certain embodiments, the handgrip 236 includes an RF transceiver, such as a Bluetooth transceiver 253, allowing the handgrip 236 to couple with and communicate with the battery box 136, for example, to activate the weapon system. In certain embodiments, the proximity of the tactical glove is required to activate the weapon system. Alternatively, in certain embodiments, the weapon system includes a solenoid switch 264 operable to selectively engage a trigger lock when the glove 256 is not in proximity to the RFID reader 252 and to disengage the trigger lock when the glove 256 is in proximity to the RFID reader 252. In certain embodiments, the solenoid switch engages the trigger lock via a pin or plunger 125, which is operably connected to the trigger mechanisms, such that when the pin is inserted into the trigger mechanism, the trigger cannot be activated.

In certain embodiments, a rotary encoder 268 on the handguard 108 is electrically coupled to the laser sight via the accessory platform 128 is manually rotatable to allow the user to scroll through pages, menus, or other items of viewable information on the display 176. In alternative embodiments, scroll buttons may be used in placed of the rotary wheel, to scroll through pages, menus, or other items of viewable information on the display.

In certain embodiments, one or more user-programmable switches 272, e.g., configured as user-depressible buttons, are provided on the handgrip 236. Signals from the switches 272 are transmitted to the processor 164 via the accessory platform 104 for controlling operation of, for example, the laser sight 140, flashlight module 188, push-to-talk radio, and/or other device attached to the accessory platform 104. Exemplary functions which can be executed on the laser sight 140 using the buttons 272 include any one or more of laser selection, laser actuation, display operation, and navigation of a hierarchal menu structure or other graphical user interface on the display 176. In certain embodiments, the switches 272 include a first switch 272*a*, second switch 272*b*, and third switch 272*c*, which are user-programmable to allow the user to customize the function of each button.

In certain embodiments, the handgrip housing has an outer material having a good grip adhesion, such as silicone, and may have a textured or contoured surface for enhancing grip. The outer material may be flexible and resilient and disposed over the depressible push button switches 272.

In certain embodiments, the handgrip 236 is coupled to an RF transceiver, such as the Bluetooth transceiver 222, to allow the user to control operation of an associated device having a paired RF transceiver, such as a cell phone, smart phone, hand held data terminal, wearable device, or the like via the RF interface using one or more controls on the handgrip, such as one or more buttons or keys 272, the scroll buttons 268, and so forth. In certain embodiments, one or more of the buttons 272 actuate a push-to-talk function of an associated two-way communication system, e.g., via the Bluetooth transceiver 222. In certain embodiments, communication the associated device includes software for use in identification verification of the user to activate the weapon system.

Firearm barrel sensors on the firearm barrel 172 send signals representative of barrel conditions to the processor 164 via the circuit 126. In certain embodiments, the sensors include one or more temperature sensors 276, such as one or more thermocouples, for providing output signals representative of the temperature of the barrel 172. In certain embodiments, the sensors include one or more strain gauges 280 for providing output signals representative of the degree of mechanical stress or deformation that the barrel is undergoing, e.g., responsive to a round of ammunition being fired by the firearm 100. In certain embodiments, the sensors include one or more piezo electric sensors 284 for providing output signals representative of the degree of mechanical stress or deformation that the barrel is undergoing, e.g., responsive to a round of ammunition being fired by the firearm 100.

Exemplary barrels having sensors thereon are disclosed in commonly owned U.S. provisional application No. 62/446,222 filed Jan. 13, 2017 and commonly owned U.S. provisional application No. 62/513,738 filed Jun. 1, 2017. Each of the aforementioned provisional applications is incorporated here by reference in its entirety.

In certain embodiments, bullet projectile velocity is calculated by the processor 164, e.g., using the sensors 280 and 284. In certain embodiments, bullet velocity information is logged in a bullet velocity database 304 stored in the memory 168 and may be displayed to the user on the display 176, e.g., as an item of information accessed by the user using the scroll buttons 268.

In certain embodiments, barrel temperature is calculated by the processor 164, e.g., using the sensor 276. In certain embodiments, barrel temperature information is logged in a barrel temperature database 308 stored in the memory 168 and may be displayed to the user on the display 176, e.g., as an item of information accessed by the user using the scroll buttons 268.

In certain embodiments, signals from the strain gauges 280 and/or piezo electric sensors 284 are sent to the processor for signal processing and/or data storage. It will be recognized that the processor 164 may include and is intended to encompass associated signal processors such as analog-to-digital converters, digital signal processors, and the like, which may be implemented as functional modules within a single, e.g., general purpose, processing unit or as discrete or dedicated hardware processors.

In certain embodiments, the system continuously monitors the barrel sensors 276, 280, 284. Signal parameters indicative of a round being fired are detected and logged in a round count database 300 stored in the memory 168. The number of rounds fired may be displayed to the user on the display 176, e.g., as an item of information accessed by the user using the scroll buttons 268.

The firing of a round is a wear-creating event. In certain embodiments, each round that is fired is associated with an incremental unit of barrel wear. Each incremental unit of barrel wear is logged in a barrel wear database 316 stored in the memory 168. The accumulated wear is compared to a preselected wear limit, which may be, for example, the barrel wear (or estimated or predicted barrel wear) that is associated with a certain degree of accuracy loss. The accumulated barrel wear may be displayed in the display 176 and may be indicated in a number of ways, for example, as a percentage of barrel life remaining, calculated as:

100×(1−accumulated wear/wear limit)

or, alternatively, as a percentage of barrel life consumed:

100×accumulated wear/wear limit

A basic embodiment of the system may base the wear accumulation based solely on the number of rounds fired. In alternative embodiments, the severity of the wear created can be estimated based on other system parameters, such as the barrel temperature, which may be monitored and logged at periodic intervals in the barrel temperature database 308, or ammunition type, which may be read by the RFID reader 220 and logged in an ammunition database 362 in the memory 168.

For example, rounds fired when the barrel is at a high temperature generate increments of barrel wear that are more severe than rounds fired when the barrel is not at a high temperature. Similarly, rounds that have increased quantities primer and propellant/powder (e.g., high velocity rounds) generate increments of barrel wear that are more severe than rounds that have lower amounts of primer and propellant/powder (e.g., low velocity rounds). The severity of barrel wear is affected by the type of primer and propellant/powder in the round.

In certain embodiments, the system estimates the incremental wear associated with firing each round and quantifies the severities based on round type, barrel temperature, rate of fire, and so forth, which provides an improved estimate of barrel wear over wear estimates based solely on the number of rounds fired. In certain embodiments, the severity of wear can be further estimated based on predicted interactions of firearm parameters with each other and/or with interactions of firearm parameters and the current accumulated barrel wear. In certain embodiments, the estimated severity of a given firing event is used to denominate the incremental wear associated with each firing event into units of normalized rounds fired and, as rounds are fired, wear increments in normalized units are added to the preexisting cumulative barrel wear stored in the wear database 316.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A weapon system for a firearm having a barrel, the weapon system comprising:

a powered accessory rail interface having an upper accessory rail and a lower accessory rail;

a first accessory device removably attachable to the upper accessory rail, the first accessory device configured to receive electrical power and data signals over the powered accessory rail interface;

a second accessory device removably attachable to the lower accessory rail, the second accessory device configured to receive electrical power and data signals over the powered accessory rail interface;

a power supply electrically coupled to the powered accessory rail interface; and a first RFID reader.

2. The weapon system of claim 1, wherein the powered accessory rail comprises an upper handguard and a lower handguard opposing the upper handguard, the upper handguard and lower handguard cooperating to form a sleeve around the barrel.

3. The weapon system of claim 2, wherein the powered accessory rail further comprises an electrical circuit within the sleeve.

4. The weapon system of claim 3, wherein at least a portion of the electrical circuit is formed on a flexible circuit substrate.

5. The weapon system of claim 2, wherein the upper accessory rail is attached to the upper handguard.

6. The weapon system of claim 5, further comprising an accessory mounting pad on the upper handguard, the accessory mounting pad configured to removably retain the first accessory device.

7. The weapon system of claim 2, wherein the lower accessory rail is attached to the lower handguard.

8. The weapon system of claim 2, wherein the power supply is a battery box electrically coupled to the lower accessory rail.

9. The weapon system of claim 8, further comprising a battery level circuit for determining a charge level of one or more batteries located in the battery box.

10. The weapon system of claim 9, wherein the RF transceiver is a Bluetooth transceiver.

11. The weapon system of claim 8, further comprising an RF transceiver.

12. The weapon system of claim 8, wherein the first RFID reader is located in the battery box.

13. The weapon system of claim 12, further comprising one or ammunition magazines, each of the one or more ammunition magazines having an RFID chip readable by the RFID reader, the RFID chip configured to transmit information representative of ammunition type to the first RFID reader.

14. The weapon system of claim 2, wherein the power supply is housed within a pistol grip of the firearm.

15. The weapon system of claim 14, further comprising an RF transceiver.

16. The weapon system of claim 15, wherein the RF transceiver is a Bluetooth transceiver.

17. The weapon system of claim 15, further comprising a remote programming fob configured to transmit one or more user program settings to the weapon system via the RF transceiver.

18. The weapon system of claim 17, wherein the remote programming fob is programmable with one or more of a computer, laptop, and mobile computing device.

19. The weapon system of claim 15, wherein the weapon system is programmable via the RF transceiver with one or more of a computer, laptop, and mobile computing device.

20. The weapon system of claim 14, further comprising a second RFID reader.

21. The weapon system of claim 20, further comprising tactical glove with a RFID chip readable by the second RFID reader, the RFID chip configured to transmit user-identifying information to the second RFID reader.

22. The weapon system of claim 21, further comprising a safety mechanism housed within the pistol grip, the safety mechanism configured to prevent operation of the firearm when the tactical glove with RFID chip is not in proximity to the second RFID reader.

23. The weapon system of claim 22, wherein the safety mechanism comprises a plunger and a solenoid configured to selectively lock and unlock a trigger mechanism of the firearm.

24. The weapon system of claim 14, wherein the pistol grip further comprises a battery level circuit for determining a charge level of one or more batteries located within the pistol grip.

25. The weapon system of claim 14, wherein the pistol grip includes one or more user input devices for controlling operation of the weapon system, the one or more user input devices selected from the group consisting of one or more buttons, a keypad, a rotary encoder, or any combination thereof.

26. The weapon system of claim 1, wherein the first accessory device comprises a processor and a memory associated with the processor, the memory storing a program of instructions for execution by the processor.

27. The weapon system of claim 26, wherein the program of instructions comprises a ballistic calculation module, wherein ballistic calculations are based on a distance to target and at least one of ammunition type, a property of the barrel, and a rate of fire of the firearm.

28. The weapon system of claim 27, wherein the property of barrel is selected from the group consisting of barrel whip, barrel harmonics, barrel temperature, or any combination of the foregoing.

29. The weapon system of claim 27, further comprising an ammunition database stored in the memory, the ammunition database containing ballistic properties of a plurality of ammunition types for use by the ballistics calculation module.

30. The weapon system of claim 26, further comprising one or more data logs in the memory, the one or more data logs for storing information relating to the firearm.

31. The weapon system of claim 30, wherein the information relating to the firearm is selected from the group consisting of: a distance to target, a number of ammunition rounds fired by the firearm, barrel temperature, barrel life expectancy, barrel wear, projectile velocity, rate of fire, firearm cant, aiming direction, battery power, barrel whip, a laser sight mode, and any combination of the foregoing.

32. The weapon system of claim 30, wherein the first accessory device includes one or both of a laser sight and a reflex sight.

33. The weapon system of claim 30, wherein the first accessory device comprises a laser sight with an integrated reflex sight.

34. The weapon system of claim 30, wherein the first accessory device comprises an orientation sensor configured to detect one or both of a firearm aiming direction and firearm cant.

35. The weapon system of claim 34, wherein the program of instructions comprises a friend-foe module for comparing a firearm aiming direction with a known position of one or more allied team members.

36. The weapon system of claim 26, further comprising an optical range finder.

37. The weapon system of claim 36, wherein the processor is configured to adjust an associated laser sight based on a distance to target.

38. The weapon system of claim 37, wherein the optical range finder is configured to communicate the distance to target to the first accessory device via the powered accessory rail interface.

39. The weapon system of claim 26, further comprising a flashlight with an integral optical range finder.

40. The weapon system of claim 1, further comprising a third accessory device, the third accessory device configured to receive electrical power over the powered accessory rail interface.

41. The weapon system of claim 40, wherein the third accessory device is a camera.

42. The weapon system of claim 41, wherein the camera is selected from the group consisting of a thermal camera, a CMOS camera, and a SWIR camera.

43. The weapon system of claim 40, further comprising:

a pivot platform removably attachable to the upper accessory rail, the pivot platform for retaining the third accessory device, the pivot platform having a hinged mounting member pivotal between a first, operative position wherein the third accessory device is aligned with the first accessory device and a second, stowed position, wherein the third accessory device is moved out of alignment with the first accessory device.

44. The weapon system of claim 1, further comprising one or more sensors on the barrel for sensing one or more of: barrel temperature, barrel strain, a projectile being fired, and a velocity of the projectile.

* * * * *